United States Patent [19]

Dworjanyn

[11] 3,932,571

[45] Jan. 13, 1976

[54] PROCESS FOR DYEING UNDRAWN ACRYLONITRILE POLYMER FILAMENTS

[75] Inventor: Lee Oleh Dworjanyn, Camden, S.C.

[73] Assignee: E. I. Du Pont de Nemours and Company, Wilmington, Del.

[22] Filed: Oct. 17, 1973

[21] Appl. No.: 407,264

Related U.S. Application Data

[63] Continuation-in-part of Ser. No. 310,955, Nov. 30, 1972, abandoned.

[52] U.S. Cl. ..... 264/78; 264/203; 264/206

[51] Int. Cl.[2] ..... D01F 6/18

[58] Field of Search..... 264/182, 78, 210 Z, 203, 264/206

[56] References Cited

UNITED STATES PATENTS

| | | | |
|---|---|---|---|
| 3,124,631 | 3/1964 | Davis et al. | 264/290 |
| 3,433,861 | 3/1969 | Hamilton | 264/78 |

FOREIGN PATENTS OR APPLICATIONS

| | | | |
|---|---|---|---|
| 734,974 | 8/1955 | United Kingdom | 264/206 |
| 183,560 | 12/1960 | Netherlands | 264/206 |

*Primary Examiner*—Jay H. Woo

[57] ABSTRACT

Process for dyeing substantially undrawn dry-spun filaments of acrylonitrile polymer which comprises extracting spinning solvent from moistened dry-spun filaments of acrylonitrile polymer to below 10% by weight of the filaments and at below 80°C., dyeing the extracted filaments in a dye bath at below 80°C. by initially contacting the filaments with the dye at nearly zero stretch, followed by stretching the filaments from 1.5× to 4.5× at between 60° – 80°C. while still contacting the dye solution.

7 Claims, 1 Drawing Figure

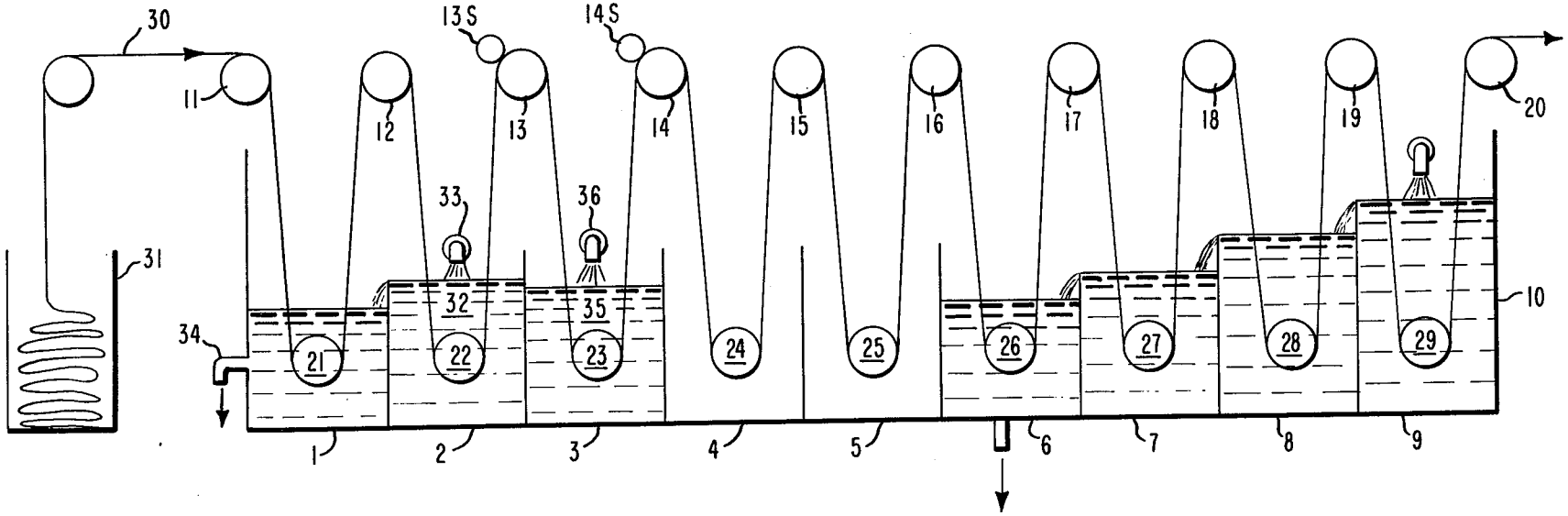
20
10
29
9
19
28
8
18
27
7
17
26
6
16
25
5
15
24
4
14
14S
36
35
23
3
13
13S
33
32
22
2
12
21
1
11
34
30
31

PROCESS FOR DYEING UNDRAWN ACRYLONITRILE POLYMER FILAMENTS

REFERENCE TO RELATED APPLICATION

This is a continuation-in-part of my copending application Ser. No. 310,955, filed Nov. 30, 1972, and now abandoned.

FIELD OF THE INVENTION

This invention relates to a process for dyeing dryspun tow of acrylonitrile polymer filaments, i.e., acrylic filaments. More particularly, the invention is directed to a process for dyeing such filaments in a continuous process during their manufacture from acrylonitrile polymer.

BACKGROUND OF THE INVENTION

Acrylic filaments have always been difficult to dye, and methods for dyeing them have generally included special dyeing techniques and dyes, even when copolymeric dye sites are incorporated in the acrylonitrile polymer of which the filaments are composed. These methods have ordinarily caused the dyeing of acrylic filaments to be carried out in steps separate from the spinning and drawing of the fibers.

The economic and technical advantage of spinning and dyeing as-spun acrylic filaments in a continuous sequence of operations are apparent, and methods for such have been developed for acrylic filaments that are wet-spun. These methods are described in, e.g., Cresswell U.S. Pat. No. 2,558,735, Moore U.S. Pat. No. 3,113,827, Wirth et al. U.S. Pat. No. 3,111,357, Briar et al. U.S. Pat. No. 3,296,341, and Knudsen U.S. Pat. No. 3,242,243. However, because of the inherent differences between wet- and dry-spinning procedures, the techniques that have been developed for dyeing wet-spun acrylic filaments are not well adaptable for use with dry-spun acrylic filaments. Thus, wet-spinning dyeing procedures generally require the formation of a gel of the filament which, of course, is not feasible in a continuous dry-spinning operation. Consequently, methods have been sought to dye dry-spun acrylic filaments continuously during the production of the filaments. This has been termed the "producer dyeing" of filaments.

In preparing such producer-dyed filaments, it had generally been believed that the presence of spinning solvent must be maintained in freshly spun dry-spun acrylic filaments in order to plasticize the fiber and thus aid in taking-up dye. Experience showed that the dye up-take of dry-spun acrylic filaments that had been extracted in hot water at 90°–100°C. to remove the spinning solvent was far too slow to permit continuous spin-dye operations. Moreover, experience showed that dry-spun acrylic filaments extracted at 65°C. to remove solvent did not dye well at a later time when subjected to a dye bath while being stretched.

Accordingly, attempts were made to dye the dry-spun filaments immediately after spinning and before extraction of the solvent. This procedure, however, leads to contamination of equipment used in later steps, as well as to contamination of spinning solvent that is later recovered and recycled, with dye, dye assistants and residual counter-ions originally associated with the dye.

The search for methods of dyeing dry-spun acrylonitrile polymer filaments continuously during the production of the filaments has continued; and it has now been discovered, surprisingly, that substantially undrawn dry-spun acrylic filaments from which the residual spinning solvent has not been removed can be subjected to extraction steps to remove spinning solvent and dyed in an operation continuous with spinning and drawing provided certain process conditions are met. Such conditions include control of temperature during extraction and dyeing (not over 80°C.), control of the amount of liquid remaining on the filaments after extraction and dyeing, and drawing the filaments within certain prescribed limits, provided that substantially no draw is carried out when the filaments first contact the dye.

SUMMARY OF THE INVENTION

Thus, this invention is a process for dyeing substantially undrawn filaments of dry-spun acrylonitrile polymer from which the spinning solvent has not been removed, which comprises the following steps:

1. passing a bundle of said filaments through an aqueous extraction bath having a temperature below about 80°C. and at a rate of at least about 10 yards per minute, until the spinning solvent content of the filaments is below about 10% by weight of the filaments;
2. squeezing the bundle of filaments under pressure sufficiently heavy to remove most of the extraction bath liquid therefrom;
3. passing the bundle of filaments into contact with a liquid dye mixture at a temperature below about 80°C. at nearly zero stretch;
4. drawing the filaments between about 1.5× and 4.5× at a temperature between about 60° and 80°C. while the filaments are still in contact with the liquid dye mixture; and
5. removing excessive liquid by squeezing the bundle of filaments under pressure sufficiently light to retain upon the filaments an amount of liquid substantially greater than the amount present prior to their contact with the liquid dye mixture, so that there is a net pick-up of liquid dye mixture on the filaments and they remain in contact with the liquid dye mixture.

In accordance with the invention, drawing step (4) may be carried out either before or after squeezing step (5). After allowing dyed and drawn filaments to set for at least about two seconds, the filaments can be contacted with an aqueous medium to rinse them of excess dye.

DESCRIPTION OF THE DRAWING

The FIGURE is a schematic drawing of the apparatus used in the process of this invention.

DESCRIPTION OF THE INVENTION

The acrylonitrile polymer filaments are dry-spun filaments, formed by spinning a solution of acrylonitrile polymer in a solvent for the polymer, such as dimethylformamide, dimethylacetamide or dimethylsulfoxide. The solution is heated and extruded through spinnerets into a hot inert gas where most of the spinning solvent vaporizes. The filaments so spun normally contain from about 10 to 30% of the spinning solvent, based on the weight of the filaments, and usually 20% or more. After the filaments are spun they are collected into ropes or tows, which are then moistened; usually about 20 to 75% water is applied, based on the dry weight of the tow. If desired, an amount of water equal to or even slightly greater than the dry weight of the tow can be applied.

In the dyeing process of this invention, the residual spinning solvent is removed by aqueous extraction until the solvent content is below 10 and preferably below 4%. Ordinarily the aqueous extraction medium is water and the filaments are immersed in a series of extraction tanks until the solvent content is reduced to below the minimum required. A nominal draw of up to about 1.2× may be imposed on the filaments during this extraction step to take up the slack in the filaments and keep them taut; however, it is preferred that orientation of the filaments imposed by drawing be minimized prior to the dyeing step.

It is also important that the temperature during extraction as well as during the dyeing and the subsequent drawing steps be below 80°C., for if the temperature goes much over 80°C., the imbibition and fixation of dye by the filaments is markedly reduced. In general, temperatures in all steps should not go much below about 60°C. because the filaments become subject to breakage during handling below about that temperature.

It is preferred that the sequence of steps be carried out continuously. It is important that the filaments not be allowed to become dry or substantially dry after their spinning, or after their extraction, or after their drawing immediately subsequent to dyeing. To do so, apparently changes the filament morphology so as to hinder dye imbibition and fixation.

It is also important that the initial contact of dye on the filaments be made at nearly zero stretch. This zero stretch may be only momentary, for the filaments may then be drawn in the dye bath, or they can be passed out of the dye bath and drawn in air while still laden with dye solution. The temperature of the filaments during this drawing step should not fall below 60°C. since breakage increases as the filaments are drawn at lower temperatures.

Finally, following the drawing step, the filaments should be permitted to remain wet with dye for a short time in order to set the dye. A time of about two seconds is sufficient, although 10 seconds or more may be preferred in some instances. To ensure medium shades, ten seconds can be used; while for deep shades, a lapse of 100 seconds or more may be used. After the dye is set, any excess dye may be rinsed off.

After the filaments have been rinsed with an aqueous medium, usually water at 90°–95°C., they may be drawn once more to enhance their physical properties; however, this second draw step is an optional one which depends on the properties desired and on the amount of draw in the first draw step. The rinse can be either a bath or a spray in which the filaments are contacted with the rinse medium to remove excess dye solution.

To aid in understanding the invention, reference is made to the figure in which reservoir tanks 1–9 in wash-draw apparatus 10 are provided with driven rolls 11–19 above the entrance to each tank and driven roll 20 at the exit of the apparatus, as well as idler rolls 21–29 within each tank. A bundle 30 of dry-spun filaments of acrylonitrile polymer containing residual spinning solvent is withdrawn from container 31 and passed through the wash-draw apparatus. The bundle is collected from the spinning machine and is not allowed to dry out. In practice, one may, if desired, feed the filaments directly from the spinning machine to the wash-draw apparatus. In tanks 1 and 2 the bundle is passed through a countercurrent flow of wash water 32 which is admitted through an inlet 33 into tank 2 and withdrawn through an outlet 34 from tank 1. Excess water is removed with the aid of squeeze roll 13s and falls back into tank 2. The pressure in this squeezing step should be sufficient to squeeze the filaments fairly dry (i.e., so that they contain less than about 40% liquid, based on the weight of the filaments). The bundle is passed into tank 3 containing dye bath 35 admitted through inlet 36. The bundle of filaments is passed through tank 3 and leaves it carrying liquid dye mixture. Excess dye mixture is removed with the aid of squeeze roll 14s as the bundle leaves tank 3, the excess dye mixture being allowed to flow back into tank 3. The pressure in this squeezing step should be fairly light, so that the amount of liquid retained upon the filaments is substantially greater than the amount present prior to their contact with the liquid dye mixture (i.e., so that there is a net pickup of dye liquid). A level of about 55 – 70% liquid on the filaments is usually appropriate. The moving bundle, wetted with the dye mixture, is next passed through two empty tanks 4 and 5, in which a draw of 2× is imposed between idler roll 24 and driven roll 15. The filament bundle is next passed through the remaining four tanks 6, 7, 8, and 9, in which it is subjected to an aqueous rinse with water at about 90°C. As the bundle of filaments leaves the wash-draw apparatus, a second draw may be imposed upon the filament bundle, if desired, between idler roll 29 and driven roll 20 to bring the total draw imposed in the wash-draw apparatus to that desired. Subsequently the dyed, drawn tow is subjected to a conventional drying step (not shown).

Although the foregoing description describes a procedure in which the dyed filaments are drawn in air after leaving dye tank 3, tank 4 may also be filled with dye mixture so that the filaments are drawn while still in the dye bath. In this case, a squeeze roll would also be used in conjunction with driven roll 15, and the draw would be imposed between idler roll 24 in the dye bath and driven roll 15.

It will be appreciated that the number of tanks in the apparatus can be increased or decreased, and that the number of tanks devoted to each step can be changed, so long as the steps comprising the process of the invention are carried out as defined in the Summary of the Invention above. For instance, in the 9-tank apparatus shown in the figure, the first four tanks may be employed as extraction tanks with countercurrent flow of wash water; the fifth tank may be used to apply the dye mixture; the bundle may be drawn as it leaves the fifth tank and passed into an empty sixth tank so that the bundle will remain wet with dye mixture at least two seconds prior to rinsing; and the final three tanks may be used as rinse tanks. Additional tanks may be added, or the process steps may be split, using two groups of tanks to carry out the process.

The bundle of filaments may be a rope of acrylonitrile polymer filaments containing on the order of 1,000 filaments or more, or a tow formed by combining several such ropes and containing up to 500,000 or 1,000,000 filaments or even more. Prior to entering the wash-draw apparatus, the bundle of filaments is preferably spread into a sheet of filaments.

The acrylonitrile polymers used to make the filaments employed in this invention are defined as long chain synthetic polymers composed of acrylonitrile units of the formula

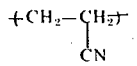

in the polymer chain. As is well understood, the term includes the homopolymer of acrylonitrile (i.e., polyacrylonitrile) and copolymers of acrylonitrile and one or more suitable monoethylenically unsaturated monomers copolymerizable with acrylonitrile. Among the typical addition monomers exemplary of those which are copolymerizable with polyacrylonitrile are methyl acrylate, methyl methacrylate, vinyl acetate, styrene, methacrylamide, methacrylonitrile, vinyl chloride, vinyl bromide, vinylidene chloride, methyl vinyl ketone and the like as well as any of the available vinyl pyridines. The preferred comonomers include methyl acrylate, vinyl acetate, vinyl chloride, styrene and the vinyl pyridines. Sulfonate comonomers can also be employed, e.g., the sulfonated styrenes, vinyl sulfonate, allyl sulfonate, methallyl sulfonate and their alkali-metal or alkaline-earth-metal salts, and the like; it being necessary only that the compound chosen from this class be copolymerizable with acrylonitrile to the desired extent. The preferred sulfonate comonomers are the sulfonated styrenes.

The dyes useful in dyeing the filaments of acrylonitrile polymer must be soluble in a suitable solvent therefore, or at least dispersible in the solvent. Dyes having a particle size of not more than 100A are readily imbibed in an acrylonitrile polymer filament. The term "liquid dye mixture" is limited to those classes of mixtures. A suitable solvent for many dyes is a mixture of glycollic acid and water. The dyes may be selected from any of a wide number of dyestuff classes. Preferably, the dye chosen for the use is substantive to the acrylonitrile polymer substrate of the particular filaments which are being spun and drawn. Thus, basic dyes are particularly suited for use with acrylic fibers containing anionic sites; and acid dyes are suited for use with acrylic fibers containing basic sites. Many disperse dyestuffs are useful for acrylic fibers containing either acid or basic dye sites, as well as for filaments composed of acrylonitrile polymers containing neutral comonomers. The term "dyes" is intended to comprehend not only colored dyestuffs, but also optical brighteners and other materials which modify the visual appearance of luster of the filaments. Concentration of dye in the dye bath may range from about 0.1 to about 12% by weight, depending on the amount of dye on fiber desired.

The invention is further illustrated by the following examples; however, the invention is not intended to be limited thereby. All percents are by weight unless otherwise specified.

EXAMPLE I

Acrylonitrile polymer filaments are prepared by dry spinning a dimethylformamide solution of a terpolymer containing about 93.9% acrylonitrile, 6% methyl acrylate, and 0.1% sodium styrenesulfonate. The filaments, which contain about 25% dimethylformamide, are collected in the form of a rope containing about 40,000 individual filaments having an as-spun denier of about 10. The rope is fed at a speed of 26 yards per minute to a wash-draw apparatus of the kind shown in the Figure. In the first two tanks, the rope is passed through a flow of countercurrent water at 65°C., extracting dimethylformamide from the spun rope to a residual level of about 6%. Excess water is squeezed off with a nip roll at the exit of the second tank under pressure sufficient to leave the rope fairly dry, and the rope is passed through a 2.6% solution of the dye having the Color Index identification of Basic Blue 77 in the third tank. Excess dye is squeezed off under light pressure at the exit of the third tank, so that there is a net pickup of dye liquid as the filaments pass through the third tank, and the rope is then passed directly across the empty fourth tank to the driven roll at the entrance of the fifth tank, with a draw ratio of 1.5× being imposed in the rope as the rope crosses the fourth tank. Additional draw is imposed in the rope as it passes through the empty fifth tank to give a total draw of 2× between the third tank and the exit of the fifth tank. The sixth tank is also empty. The rope is rinsed in the last three tanks in 95°C. water flowing countercurrent to the motion of the rope and is drawn an additional 2.2× (total draw 4.4×) before leaving the wash-draw machine. At the speed employed, there is an interval of 12 seconds after the initial 1.5× draw is applied, before the rope enters the rinse bath in the seventh tank. The rope is uniformly dyed a deep sky blue color.

The above procedure is repeated, except that the rope is fed at a speed of 17 yards per minute. In this run there is an interval of 18 seconds after the initial 1.5× draw is applied, before the rope enters the rinse bath. The rope is dyed a sky blue color.

EXAMPLE II

A rope of acrylonitrile polymer filaments prepared as in Example I is fed at a speed of 60 yards per minute to the wash-draw apparatus of the Figure where it is treated as described in Example I except that the sixth, seventh, eight, and ninth tanks are all used as rinse tanks. In these last four tanks the rope is passed through water at 95°C. to provide an aqueous rinse, and as the rope leaves the ninth tank a final draw of 2.2× is imposed in the rope. At the speed employed, there is an interval of 3 seconds after the initial 1.5× draw is applied, before the rope enters the rinse bath in the sixth tank. The dyed, drawn, and rinsed rope is then dried at a temperature of 130°C. for an exposure time of 30 minutes. It is observed that the tow is uniformly dyed to a sky blue color.

EXAMPLE III

Acrylonitrile polymer filaments are prepared by dry spinning a dimethylformamide solution of a terpolymer containing about 93.8% acrylonitrile, 6% methyl acrylate, and about 0.2% sodium styrenesulfonate. The filaments, which contain about 20% dimethylformamide, are collected in the form of a rope which has a total denier of about 390,000 with individual filaments having an as-spun denier of about 11. The rope is spread to form a sheet about 3 inches wide and is fed at a speed of about 40 yards per minute to a washdraw apparatus comprising a series of nine reservoir tanks equipped with driven rolls above the reservoirs and idler rolls within the reservoirs to guide the rope from the entrance to the exit of the wash-draw apparatus. In the first six tanks, the rope is passed through a flow of countercurrent water at 70°–75°C. while a stretch of 1.1 to 1.2× is applied to the filaments. The rope emerging from the sixth tank has a concentration of residual dimethylformamide of about 6%, while the concentration of the dimethylformamide in the countercurrent wash water rises from 1.5% in the sixth tank to 12% in the first tank. The seventh tank is skipped, being employed solely to collect water slung from the rope. The eighth and ninth tanks in the apparatus contain a solution of a red dye formulation at a concentration of 11 % and a temperature of 70°–75°C. The red dye formulation consists of the following amounts of dyes having the following Color Index identifications: 72.9% Basic Red 15, 26.0% Basic Yellow 29, and 1.1% Basic Blue 77. As the rope leaves the ninth tank, a draw of 2.3× is applied to the rope, after which it is deposited in a collection can. The rope collected in the can is found to have a concentration of 4% of the dye on the fiber.

The dyed rope collected in the can, after a lapse of at least one hour, is continuously withdrawn from the can and passed into a second wash-draw apparatus having the same construction as the first apparatus described in the paragraph above, and in the second apparatus the rope is continuously rinsed with a countercurrent flow of water at 95°C. As the rope leaves the ninth tank in the wash-draw apparatus, an additional draw of 2.0× is imposed. The rope is then crimped and deposited upon a tray, upon which it is dried at 130°C. for an exposure time of 12 minutes. It is observed that the rope is dyed a deep shade of red.

EXAMPLE IV

A tow of acrylonitrile polymer filaments is prepared by dry spinning a dimethylformamide solution of a terpolymer containing about 93.94% acrylonitrile, 6% methyl acrylate, and 0.06% sodium styrenesulfonate. The filaments, which contain about 22% dimethylformamide, are collected in the form of a rope containing about 12,000 individual filaments having an as-spun denier of about 12 dpf, and the rope is moistened with about 70% water, based on its dry weight. The rope, collected from the spinnerets on creels, is maintained in its moistened, as-spun condition at about 20°–28°C. for about 24 hours, and is then fed at a speed of 90 yards per minute to a wash-draw apparatus of the type shown in the figure except that it has 10 tanks.

In the first seven tanks, the rope is passed through a flow of countercurrent water at 75°C. while a stretch of 1.2× is applied to draw the rope through the tanks. The rope emerging from the seventh tank contains about 3% dimethylformamide. As it leaves the tank, excess water is squeezed off under pressure sufficient to leave the rope fairly dry. The rope then enters tanks 8, 9, and 10 containing a solution of a red dye formulation at a concentration of 2.6% and a temperature of 75°C. The red dye formulation consists of the following amounts of dyes having the following Color Index identifications: 72.7% Basic Red 15, 25.7% Basic Yellow 29, and 1.6% Basic Blue 77. The rope passes through the first dye bath without any draw and then is drawn slightly, about 1.1×, in the second bath and fully in the last tank for a total draw of 2.2× in the dye solution. As the rope leaves the last tank of dye in the apparatus, it is subjected to a light squeeze, removing excess dye solution, but resulting in a considerable net pickup of liquid on the filaments between the squeezing step after the extraction tanks and the squeezing step after the dye tanks. The dyed rope is collected and rinsed with 95°C. water after 6 hours. Analysis of the fiber shows 1.4% dye in fiber. Analysis of rinse water shows that more than 99% of the dye applied is fixed.

EXAMPLE V

Acrylonitrile polymer filaments are prepared by dry spinning a dimethylformamide solution of a terpolymer containing about 93.84% acrylonitrile, 6.1% methyl acrylate, and 0.1% sodium styrene sulfonate. The filaments, which contain about 23% dimethylformamide, are collected in the form of a ribbon containing about 19,600 individual filaments having an as-spun denier of 19.2 dpf, and the ribbon is moistened with about 70% water, based on its dry weight. The ribbon, collected from the spinnerets in cans, is maintained in its moistened, as-spun condition at about 20° to 28°C. for about 24 hours. Four such ribbons of filaments are then fed, side-by-side, to a wash-draw apparatus of the type shown in the figure, except that it has 10 tanks.

In the first seven tanks, the ribbons are passed through a flow of countercurrent water at 73°C. while a stretch of 1.14× is applied to draw the ribbons through the tanks. The ribbons emerging from the seventh tank contain about 2% dimethylformamide. As the ribbons leave the seventh tank, they are first given a light squeeze by passing them between rubber-covered rolls and are then subjected to a heavy squeeze between steel rolls, reducing the level of liquid carried on the moving filaments to below about 40%. The ribbons then enter tanks 8, 9, and 10 containing a solution of a navy blue dye formulation at a concentration of 5.85% and a temperature of 73°C. The navy blue dye formulation consists of a solution of dyes having the Color Index identifications of Basic Red 15 (10.13% by weight) and Basic Green 4 (23.27% by weight) in 66.6% by weight of a 70%/30% mixture of glycollic acid and water. The ribbons pass through the first dye bath without any draw and then are drawn slightly, about 1.1×, in the second bath and fully in the last tank for a total draw of 2.2× in the dye solution. The speed of the ribbons as they leave the last tank in the apparatus is 350 ypm. As the ribbons leave the last tank of dye in the apparatus, they are subjected to a light squeeze, reducing the level of liquid (water and other evaporatable liquids) carried out of the tank on the filaments to 62%, based on filament weight. The four dyed ribbons are collected together as a rope.

A sample of the rope about five feet in length is cut off as it leaves the apparatus and a 1 foot sample of this is rinsed immediately with 3000 ml. of 60°C. water (fiber sample placed in rinse bath in less than 30 seconds after leaving dye bath). Additional 1 foot samples are cut off and rinsed after being allowed to stand for measured intervals of time. The amount of dye in each sample of rope is determined by dissolving the filaments in dimethylformamide and measuring the dye concentration with the aid of a spectrophotometer, and from this value the percentage of dye on fiber is calculated. The amount of dye in each rinse bath is also determined with the aid of a spectrophotometer, and from this additional data the fixation of dye (percentage of dye not rinsed from the fiber based on the total amount of dye in the fiber and the liquid surrounding the fiber) is calculated. The results are shown in the table for various time periods before rinsing.

In two separate comparison runs outside the scope of the invention, the experiment is repeated. In one comparison run, the extraction baths and dye baths are maintained at 87°C. In the other comparison run, the extraction baths and dye baths are maintained at 95°C. The results of these runs are also shown in the table.

TABLE

Influence of Temperature Upon Dye Uptake

| Temperature of Extraction and Dye Baths | Time Before Rinsing | Fixation (%) | Dye on Fiber (%) |
|---|---|---|---|
| 73°C. | <30 sec. | 53.1 | 1.30 |
| | 15 min. | 97.4 | 2.38 |
| | 60 min. | 97.6 | 2.39 |
| 87°C. | <30 sec. | 21.6 | 0.43 |
| | 15 min. | 44.7 | 0.89 |
| | 60 min. | 75.0 | 1.49 |
| 95°C. | <30 sec. | 9.3 | 0.18 |
| | 15 min. | 73.9 | 1.43 |
| | 60 min. | 86.1 | 1.67 |

As illustrated in the table, the fixation of dye is markedly higher when the process is carried out at 73°C. than it is at 87°C. or 95°C. It is necessary to hold the samples for a whole day without rinsing to achieve high fixation values in the samples prepared at the hihger extraction and fixation temperatures (the fixation values with a 24-hour time before rinsing being 99.1%, 96.0%, and 97.1% for the 73°C., 87°C., and 95°C. samples, respectively). Even more important is the ability to reach deeper shades by carrying out the process of the invention, as shown by the higher values for dye on fiber. Even when the samples prepared at the higher extraction and fixation temperatures are held for a whole day without rinsing, the values for dye on fiber are less than 2% (the dye on fiber values with a 24-hour time before rinsing being 2.43%, 1.91%, and 1.93% for the 73°C., 85°C., and 95°C. samples, respectively).

In a duplicate experiment carried out in accordance with the first two paragraphs of Example V, using extraction baths and dye baths at 73°C., results similar to those shown in the table are obtained. The dye fixation when the sample is rinsed in <30 sec. is 61.2%, after 15 min. 94.9%, and after 60 min. 98.1%; after a whole day, dye fixation is 98.7%. The values for dye on fiber are 1.50% when rinsed in <30 sec., 2.33% after 15 min., 2.40% after 60 min., and 2.43% after a whole day.

The foregoing detailed description has been given for clearness of understanding only and no unnecessary limitations are to be understood therefrom. The invention is not limited to the exact details shown and described for obvious modifications will occur to those skilled in the art.

I claim:

1. A continuous process for dyeing dry-spun acrylonitrile polymer filaments which are substantially undrawn and contain in excess of 10% spinning solvent, by weight of the filaments, which comprises the following steps:

1. passing a bundle of said filaments through an aqueous extraction bath having a temperature below about 80°C., so that any imposed draw is nominal and at a rate of at least about 10 yards per minute, until the spinning solvent content of the filaments is below about 10% by weight of the filaments;
2. squeezing the bundle of filaments under pressure sufficiently heavy to remove most of the extraction bath liquid therefrom;
3. passing the bundle of filaments into contact with a liquid dye mixture at a temperature below about 80°C. at nearly zero stretch;
4. drawing the filaments between about 1.5× and 4.5× at a temperature between about 60° and 80°C. while the filaments are still in contact with the liquid dye mixture; and
5. removing excessive liquid by squeezing the bundle of filaments under pressure sufficiently light to retain upon the filaments an amount of liquid substantially greater than the amount present prior to their contact with the liquid dye mixture, so that there is a net pick-up of liquid dye mixture on the filaments and they remain in contact with the liquid dye mixture.

2. The process defined in claim 1, wherein the temperature in steps (1) and (3) is between about 60°C. and 80°C.

3. The process defined in claim 1, wherein the liquid dye mixture of step (3) is an aqueous solution of a basic dye and the filaments are immersed in the solution.

4. The process defined in claim 3, wherein drawing step (4) takes place while the filaments are immersed in the aqueous solution of basic dye.

5. The process defined in claim 1, wherein the drawn filaments remain in contact with liquid dye mixture for at least two seconds and are then rinsed with an aqueous medium to remove excess liquid dye mixture.

6. The process defined in claim 1, wherein the temperature in steps (1) and (3) is between about 60°C. and 80°C., any drawing of the filaments in step (1) is less than about 1.2×, the liquid dye mixture of step (3) is an aqueous solution of a basic dye and the filaments are immersed in the solution, and drawing step (4) takes place while the filaments are immersed in the aqueous solution of basic dye.

7. The process defined in claim 6, wherein the drawn filaments remain in contact with liquid dye mixture for at least ten seconds and are then rinsed with an aqueous medium to remove excess liquid dye mixture.

* * * * *